US005284614A

United States Patent [19]

Chen et al.

[11] Patent Number: 5,284,614

[45] Date of Patent: Feb. 8, 1994

[54] METHOD OF FORMING FINE DISPERSION OF CERIA IN TUNGSTEN

[75] Inventors: Li-Chyong Chen, Schenectady; Stephen L. Dole, Burnt Hills; Ronald H. Arendt, Schenectady, all of N.Y.

[73] Assignee: General Electric Company, Schenectady, N.Y.

[21] Appl. No.: 891,116

[22] Filed: Jun. 1, 1992

[51] Int. Cl.[5] ..... B22F 9/24

[52] U.S. Cl. ..... 419/20; 419/19; 419/38; 419/45; 75/359; 75/361; 75/365

[58] Field of Search ..... 75/354, 359, 361, 365, 75/370; 419/20, 42, 63

[56] References Cited

U.S. PATENT DOCUMENTS

| | | | |
|---|---|---|---|
| 3,475,159 | 10/1969 | hansen | 75/365 |
| 4,156,053 | 5/1979 | Baranow | 75/354 |
| 4,678,718 | 7/1987 | Wang | 428/560 |
| 4,787,561 | 11/1988 | Kemp et al. | 75/354 |
| 4,923,673 | 5/1990 | Litty | 419/20 |

FOREIGN PATENT DOCUMENTS

| | | |
|---|---|---|
| 59-914304 | 2/1983 | Japan . |
| 62-286698 | 6/1986 | Japan . |
| 63-170844 | 1/1987 | Japan . |

*Primary Examiner*—George Wyszomierski
*Attorney, Agent, or Firm*—James Magee, Jr.

[57] ABSTRACT

Doped tungsten powder, or sintered tungsten bodies formed therefrom, having a fine dispersion of oxide particles of at least one metal from the group zirconium, hafnium, lanthanum, yttrium, and rare earth's are formed by the method of this invention. A mixture of a salt solution comprised of a soluble salt of the metal, and a tungsten blue oxide powder is formed. A hydroxide precipitating solution is admixed with the mixture to form a hydroxide precipitate of the metal on the tungsten blue oxide powder. The tungsten blue oxide powder and hydroxide precipitate are heated in a reducing atmosphere to form the tungsten powder having the dispersion of oxide particles. The doped tungsten powder can be consolidated and sintered to form tungsten bodies having a fine dispersion of the metal oxide.

10 Claims, No Drawings

METHOD OF FORMING FINE DISPERSION OF CERIA IN TUNGSTEN

This invention is related to tungsten powder metallurgy, and in particular, a precipitation method for forming a fine dispersion of metal oxide particles on tungsten powder, or in sintered bodies formed from the powder.

BACKGROUND OF THE INVENTION

The high melting point and vaporization temperature of tungsten has made it useful for the wire filaments in incandescent electric lamps, discharge lamps, and electrode rods for electric arc welding. Pure tungsten is known to be unsatisfactory for forming wire filaments or electrodes, because tungsten recrystallizes at a relatively low temperature. For example, grain growth throughout the operating life of the pure tungsten filament leads to the development of highly stressed grain boundaries, a high creep rate, offsetting, and early failure of the lamp filaments.

A fine equiaxed grain structure is preferred for dissipating shock and vibration energy during rough service usage of tungsten wire filaments, for example in automobile lamps. Wire comprised of dispersed thoria particles has been used for such applications. The thoria particles maintain the fine grained structure during operation by inhibiting grain growth. Tungsten comprised of dispersed thoria exhibits improved electron emission for the discharge lamp application, and greater vibration resistance to improve life in the lamp application. Tungsten rod electrodes comprised of up to about 4 percent thoria have improved ignition properties greater arc stability, higher current loading capability, and longer life due to the recrystallization inhibiting effect of thoria in the grain boundaries.

However, thoria is a radioactive material, and there is great environmental incentive to replace the thoria in tungsten rods and wires with another additive more compatible with the environment. Preferably, the replacement material will provide the improved electron emission and fine grain equiaxed grain structure having inhibited grain growth found in tungsten comprised of dispersed thoria particles.

U.S. Pat. Nos. 4,923,673 and 4,678,718, and Japanese Kokai Patents 170,844, 143,041, and 286,698 disclose tungsten rods or wires comprised of oxides of either lanthanum, yttrium, or cerium for replacing thoria. The rare earth oxide is dispersed or doped in the tungsten by either mixing a powder of the rare earth oxide with a tungsten oxide powder, or mixing a tungsten oxide powder with a nitrate solution of the rare earth. The nitrate solution mixture is heated in a reducing atmosphere to reduce the tungsten oxide, decompose the nitrate, and form a doped tungsten powder comprised of the rare earth oxide. The doped tungsten powder can be compacted and sintered to form a bar for rod or wire reduction. As used herein, the term "doped" means the intentional addition of an impurity such as ceria in a small controlled amount to improve properties such as creep-resistance or electron emission in articles formed from the doped material.

For those skilled in the art, it is well known that at a given percentage of rare earth dopant in the tungsten, a finer dispersion of the rare earth in the tungsten provides improved rod and wire reducing or drawing properties, improved uniformity of distribution of the particles in the final rod or wire, and improved resistance to recrystallization, grain growth, and grain boundary sliding. In other words, a finer distribution of the rare earth oxide provides a finer grain size tungsten and improved service life in the tungsten wire or rod.

One aspect of this invention is to provide a method for forming a fine dispersion of a metal oxide on tungsten powder.

Another aspect of this invention is to provide a fine dispersion of a metal oxide on tungsten powder by a precipitation process.

BRIEF DESCRIPTION OF THE INVENTION

The method of this invention forms tungsten powder having a fine dispersion of oxide particles of at least one metal from the group consisting essentially of zirconium, hafnium, lanthanum, yttrium, and rare earth's. A mixture of a salt solution comprised of a soluble salt of the metal, and a tungsten blue oxide powder is formed. A hydroxide precipitating solution is admixed with the mixture to form a hydroxide precipitate of the metal on the tungsten blue oxide powder. The tungsten blue oxide powder and hydroxide precipitate are heated in a reducing atmosphere to form the tungsten powder having the dispersion of oxide particles.

As used herein, the term "soluble salt" means a salt of the metal that is soluble in water, such as, oxy-chlorides, chlorides, oxy-nitrates and preferably nitrates.

As used herein, the term "hydroxide precipitating solution" means a solution that causes a precipitation of the metal hydroxide from the salt solution. For example, suitable hydroxide precipitating solutions can be formed from ammonium hydroxide, tetramethyl ammonium hydroxide, sodium hydroxide, and potassium hydroxide.

DETAILED DESCRIPTION OF THE INVENTION

We have found that tungsten metal powder doped with a fine dispersion of oxide particles can be formed by a wet chemical precipitation method. The doped tungsten metal powder can be used to form sintered tungsten bodies, or the elongated bodies formed by reducing the sintered bodies, having a fine tungsten grain size, and a fine distribution of oxide particles for pinning the grain boundaries.

The doped tungsten metal powder is formed from a tungsten oxide powder, the oxide being known as tungsten blue oxide and having the approximate composition $WO_3$. Tungsten blue oxide powder particles can be formed, for example, by the decomposition of ammonium paratungstate in hydrogen. Such tungsten blue oxide particles are porous, consisting of agglomerates of very small oxide crystals, for example about 0.1 micron. The tungsten blue oxide powder can have an average particle size in the range of about 5 to 80 microns. Preferably, the tungsten blue oxide is milled to provide a uniform fine average particle size of about 2 to 7 microns.

The metallic tungsten powder is doped with an effective amount of the metal oxide to provide a fine tungsten grain size, pin grain boundaries, or improve the thermionic capability in sintered bodies formed from the powder. Tungsten powder comprised of greater than about 5 weight percent of the metal oxide can be sintered to form bars, but the bars are difficult to reduce to elongated rods or wires. The oxide is preferably in a range of about 0.5 to 3 weight percent, more preferably about 1 to 2 weight percent of the metallic tungsten powder.

The tungsten blue oxide powder is doped with a soluble salt solution of at least one of the metals from the group zirconium, hafnium, lanthanum, yttrium, and the rare earth's. A preferred rare earth is cerium. Suitable salt solutions can be formed by dissolving chlorides, oxy-chlorides, oxy-nitrates, or preferably nitrates of the metal in water, or the metal oxides can be dissolved in a hydrochloric, or nitric acid solution. The nitrates are preferred because the hydroxide precipitation products formed from precipitation of the metal nitrates, other than the metal hydroxide, are substantially removed by decomposition during reduction of the tungsten blue oxide. Precipitation products from the other salts that do not decompose during reduction of tungsten blue oxide to tungsten, such as chlorides or oxalates, can be washed from the mixture after precipitation of the hydroxides.

A sufficient concentration of the metal salt is dissolved to provide the desired weight percent of the metal oxide in the tungsten powder. Those skilled in the art can determine the quantity of salt solution needed to mix with the tungsten blue oxide to form a suspension, and the proportion of metal salt to tungsten blue oxide to give the desired weight percent of metal oxide in the tungsten metal powder.

For example, one kilogram of tungsten powder comprised of one weight percent of the metal oxide can be formed as follows. A nitrate solution comprised of about 350 milliliters of distilled water, and either 25.23 grams cerium nitrate, about 26.58 grams lanthanum nitrate, about 33.92 grams yttrium nitrate, or 16.84 grams hafnium oxy-nitrate is mixed with about 1239.85 grams of tungsten blue oxide powder, for example by magnetic stirring, ultrasonic agitation, or mechanical vibration, i.e., shaking.

A hydroxide precipitating solution is slowly admixed with the mixture to increase the mixture pH until the metal hydroxide precipitation reaction occurs. The hydroxide precipitating solution is comprised of ammonium hydroxide, or a hydroxide compound such as sodium hydroxide, potassium hydroxide, or tetramethyl ammonium hydroxide, that preferably, raises the pH of the salt suspension to about 7 to 10. Preferably, the hydroxide precipitating solution is at a suitable concentration to provide a controlled precipitation reaction, for example an aqueous solution comprised of about 5 to 15 weight percent ammonium hydroxide.

Precipitation products, such as sodium or potassium, from the alkali hydroxide precipitating solutions may not decompose during reduction of tungsten blue oxide to tungsten, and the non decomposing elements or compounds can be washed from the mixture after precipitation of the hydroxides. More preferably, the hydroxide precipitating solution is an aqueous solution of ammonium hydroxide. It was found that agitation for about 3 minutes is sufficient to complete the precipitation. The hydroxide precipitation occurs at a pH of about 7 to 8 depending upon which metal hydroxide is precipitated. The metal hydroxide precipitate is deposited on the porous tungsten blue oxide particles, and capillary action provides for some deposition of the hydroxide within the porous particles.

The tungsten blue oxide powder and the metal hydroxides are reduced to tungsten metal powder and the corresponding metal oxides, respectively, by heating the powder to about 700° to 900° C. in a reducing atmosphere such as hydrogen. A fine dispersion of the metal oxide is formed on, and within the porous tungsten metal powder particles.

The doped metallic tungsten powder can be formed into bodies by conventional tungsten powder metallurgy methods. For example, the doped powder can be cold isostatic pressed at about 25 to 30 ksi to form a bar, and the bar can be presintered at 1200° C. to improve strength. The bar can be sintered by furnace heating to about 2300° C. for about 2 hours in a protective atmosphere such as hydrogen to a density of about 97 percent of theoretical. Alternatively, the presintered bar can be sintered by self-resistance heating. A resistance heating current of about 4,000 to 6,500 amps is transmitted through the bar according to cycles well known in the art. For example, see "Application of Tungsten Wire as the Light Source in Incandescent Electric Lamps," D.J. Jones, Metallurgy and Material Technology, Volume 5 No. 10, pp. 503–512, 1973. Such resistance heating is sufficient to heat the bar to about 2,100° to 3,000° C. where it is sintered to about 85 percent of theoretical density or higher.

The sintered bar can be elongated by conventional means, such as swaging, and drawing into a rod or wire in a series of annealing and wire drawing operations. The improved fine dispersion of oxide particles provides improved forming properties in the sintered and reduced bar, reducing cracking and breakage of the tungsten during the bar forging, swaging, and drawing reduction operations. In addition, a finer dispersion of oxide particles, and finer tungsten grain size is provided in the reduced rod or wire as compared to rod or wire formed by prior the art methods.

Additional advantages of the method of this invention are shown by making reference to the following examples.

EXAMPLE 1

A nitrate solution comprised of about 5.4 grams of cerium nitrate dissolved in 70 milliliters of distilled water was mixed in a magnetic stirrer for about 15 minutes with about 246.25 grams of a tungsten blue oxide powder having a specific surface area of about 6.7 meters squared per gram. The mixture was stirred for about 3 minutes and placed in an oven at 100° C. overnight to dry, and form a deposit of cerium nitrate on the tungsten blue oxide powder. The powder was heated to 800° C. in a hydrogen atmosphere flowing at about 5 liters per minute to reduce the tungsten blue oxide and cerium nitrate to tungsten and ceria, respectively. The doped powder was cold isostatic pressed at 25 ksi, heated to 1200° C. for 20 minutes, and heated to 2300° C. for 120 minutes to form a sintered tungsten bar having a second phase of ceria.

EXAMPLE 2

A doped tungsten powder was formed as in Example 1, except during mixing of the nitrate solution and tungsten blue oxide powder, a hydroxide precipitating solution comprised of 10 weight percent ammonium hydroxide, and the balance distilled water was slowly added from a dropper. The cerium nitrate began to precipitate as cerium hydroxide when the pH increased to about 8. The powder was heated to 800° C. in a hydrogen atmosphere flowing at about 5 liters per minute to reduce the tungsten blue oxide and cerium hydroxide to tungsten and ceria, respectively. The powder was pressed and sintered as in Example 1 to form a sintered tungsten bar having a fine dispersed second phase of ceria.

The sintered tungsten bars formed in Examples 1 and 2 were cross sectioned and inspected metallographically on an image analyzer. The compact of Example 1 was found to have an average ceria particle size of about 1.5±0.8 microns, and an average tungsten grain size of about 12±0.8 microns. The compact of Example 2 was found to have an average ceria particle size of about 0.66±0.2 microns, and an average tungsten grain size of about 7±0.3 microns. The sintered tungsten bar formed from the powder doped by the ammonium hydroxide precipitation step in Example 2 exhibited an improved finer dispersion of ceria and refined tungsten grain size as compared to the sintered tungsten bar formed in Example 2 from the powder doped without the ammonium hydroxide precipitation step.

What is claimed is:

1. A method for forming tungsten powder having a fine dispersion of metal oxide particles wherein the metal is at least one of zirconium, hafnium, lanthanum, yttrium, or a rare earth, the method comprising;

forming a mixture of a salt solution comprised of a soluble salt of the metal, and a tungsten blue oxide powder, admixing a hydroxide precipitating solution to the mixture to form a hydroxide precipitate of the metal on the tungsten blue oxide powder, and heating in a reducing atmosphere to reduce the tungsten blue oxide powder and hydroxide precipitate, and form the tungsten powder having the dispersion of metal oxide particles.

2. A method according to claim 1 wherein the metal is lanthanum, yttrium, cerium, or hafnium.

3. A method according to claim 1 wherein the hydroxide precipitating solution is comprised of ammonium hydroxide.

4. A method according to claim 1 wherein the metal oxide particles have a particle size of less than about 1.5 microns.

5. A method according to claim 1, further comprising, before the step of forming the mixture, milling the tungsten blue oxide powder.

6. A method for forming an elongate body of tungsten with a fine dispersion of metal oxide particles wherein the metal is at least one of zirconium, hafnium, lanthanum, yttrium, or a rare earth, the method comprising;

forming a mixture of a salt solution comprised of a soluble salt of the metal, and a tungsten blue oxide powder, admixing a hydroxide precipitating solution to the mixture to form a hydroxide precipitate of the metal on the tungsten blue oxide powder, heating in a reducing atmosphere to reduce the tungsten blue oxide powder and hydroxide precipitate, and form the tungsten powder having the dispersion of metal oxide particles, and pressing the tungsten powder to form a compact, sintering the compact to form a bar, and reducing the bar to form the elongate body.

7. A method according to claim 6 wherein the metal is lanthanum, yttrium, cerium, or hafnium.

8. A method according to claim 6 wherein the hydroxide precipitating solution is comprised of ammonium hydroxide.

9. A method according to claim 6 wherein the metal oxide particles have a particle size of less than about 1.5 microns.

10. A method according to claim 6, further comprising, before the step of forming the mixture, milling the tungsten blue oxide powder.

* * * * *